United States Patent [19]

Eddington et al.

[11] 4,401,010

[45] Aug. 30, 1983

[54] VARIABLE-TORQUE-ACCOMMODATING MACHINE

[76] Inventors: George D. Eddington, 1500 Highland Cove La., Salt Lake City, Utah 84106; Herbert W. DeVitt, Jr., 274 S. 12th East, Salt Lake City, Utah 84102

[21] Appl. No.: 205,792

[22] Filed: Nov. 10, 1980

[51] Int. Cl.[3] ..... F01L 25/08; F01L 15/16

[52] U.S. Cl. ..... 91/273; 91/275; 92/13.1; 92/13.6; 92/13.7

[58] Field of Search ..... 91/275, 273, 245; 92/60.5, 13.6, 13.7, 13.3, 13.1

[56] References Cited

U.S. PATENT DOCUMENTS

| | | | |
|---|---|---|---|
| 356,538 | 1/1887 | Hubner | 92/13.6 |
| 1,470,381 | 10/1923 | Lamb | 91/275 |
| 2,604,079 | 7/1952 | Ray | 91/275 |
| 2,640,425 | 6/1953 | Saalfronk | 92/13.7 |
| 3,871,268 | 3/1975 | Misima | 92/13.3 |
| 3,978,672 | 9/1976 | Stenger | 92/13.6 |

*Primary Examiner*—Paul E. Maslousky

*Attorney, Agent, or Firm*—Mallinckrodt & Mallinckrodt

[57] ABSTRACT

A piston-cylinder device, such as a Rankine cycle engine, is provided with one or more variable displacement cylinders and variable stroke pistons for accommodating loads of variable torque. Cylinder displacement is varied by a movable cylinder head internally of the cylinder and auxiliary to a fixed cylinder head, and piston stroke is varied by a variably fulcrumed lever linking piston connecting rods with a crankshaft. For the engine particularly, load torques are continually sensed and cylinder displacement adjusted accordingly. In turn, the position of the movable cylinder head is continually sensed, and the lever fulcrum adjusted accordingly.

12 Claims, 11 Drawing Figures

VARIABLE-TORQUE-ACCOMMODATING MACHINE

BACKGROUND OF THE INVENTION

1. Field

The invention is in the field of engines and other machines, such as air compressors, pumps, etc., functionally dependent on one or more component piston-cylinder sets, and particularly to such machines having provision for varying cylinder work-chamber size in order to accommodate loads of variable torque.

2. State of the Art

The pertinent art has long recognized the desirability of an engine or other machine of the kind indicated which efficiently accommodates loads of variable torque. Various approaches have been taken to the construction of such machines for accomplishing this purpose. Thus, as early as the year 1887, in U.S. Pat. No. 356,538, the inventor P. F. Hubner provided movable cylinder heads for adjusting the size of cylinder work-chambers, along with gear mechanism for adapting piston stroke length to changes in cylinder work-chamber size. Other arrangements to the same general end are disclosed in U.S. Pat. Nos. 851,262; 2,640,425; 2,976,844; and 3,978,672.

Despite these efforts, there remained need for a really practical machine to accomplish the variable-torque-accommodating results sought.

OBJECTIVES

A particular objective in the making of the present invention was to provide a highly practical machine construction adapted for use, for example, in a Rankin cycle engine powered by steam or by a vapor of "Freon" type to provide efficient operation at both high and low torques, without the need for large condensor equipment to recover the vaporized fluid utilized. Such an engine, equipped with proper controls, could be directly coupled to either the front or rear wheels of a vehicle or to both, without requiring a transmission. Accordingly, another objective was to provide a practical and effective control system for the machine.

SUMMARY OF THE INVENTION

In accomplishing the foregoing objectives of the invention, one or more power cylinders are respectively provided with hydraulically movable heads internally thereof for reducing the size of the respective cylinder work-chambers from a set maximum size as determined by changes in torque loads from time to time. Pistons operable in the respective cylinders have their stroke lengths changed to accommodate changes in cylinder work-chamber size by means of linkage, including a lever having a movable fulcrum, without changing the stroke length of respective connecting rods that drive a crankshaft or other work mechanism. Control is exercised automatically by sensing changes in hydraulic pressure, changes in position of the movable heads, and changes in position of the fulcrums, and by feeding sensor signals into a data processor.

THE DRAWINGS

An embodiment representing the best mode presently contemplated for carrying out the invention in actual practice is illustrated in the accompanying drawings, in which:

FIG. 1 is a top plan view of a Rankine cycle, single cylinder engine constructed in accordance with the invention and shown as it appears at maximum power stroke;

FIG. 2, a side elevation;

FIG. 3, a bottom plan;

FIG. 4, an end elevation looking from the right in the foregoing FIGS.;

FIG. 5, a fragmentary horizontal section taken on the line 5—5 of FIG. 2;

FIG. 6, a longitudinal vertical section taken on the line 6—6 of FIG. 1 and showing by broken lines how the lever system operates with respect to the piston, the movable cylinder head in this maximum power stroke position being entirely retracted to provide a cylinder work-chamber of maximum size, and a dash pot mechanism for changing the position of the secondary cylinder head being shown schematically in axial vertical section;

FIG. 7, a view similar to that of FIG. 6, but showing the movable cylinder head extended to reduce cylinder work-chamber size and showing the fulcrum of the lever system shifted to compensate for size reduction of the cylinder work-chamber, the same extreme broken line positions of the piston and lever system being shown as in FIG. 6;

FIG. 8, a fragmentary horizontal section taken on the line 8—8 of FIG. 6;

FIG. 9, a transverse vertical section taken on the line 9—9 of FIG. 1, FIG. 10, a block diagram of the control system; and FIG. 11, a circuit diagram of the interface between a microprocessor and control solenoids.

DETAILED DESCRIPTION OF THE ILLUSTRATED EMBODIMENT

In its illustrated form, the invention is shown by way of example as a Rankine cycle, single cylinder engine operable by a pressure fluid, such as steam or a vapor of "Freon" type, supplied by suitable apparatus (not shown) associated with the engine, as for example a steam generator mounted on the chassis of a vehicle powered by the engine. Although for sake of simplicity the engine is illustrated as having a single cylinder, it should be understood that a suitable number of additional cylinders to provide the power and operative smoothness usually desired in an automotive vehicle can be provided in appropriate arrangement relative to a crankshaft having multiple cranks, or, more desirably, relative to individual cranks directly coupled to the respective wheels of the vehicle.

Figure 1:
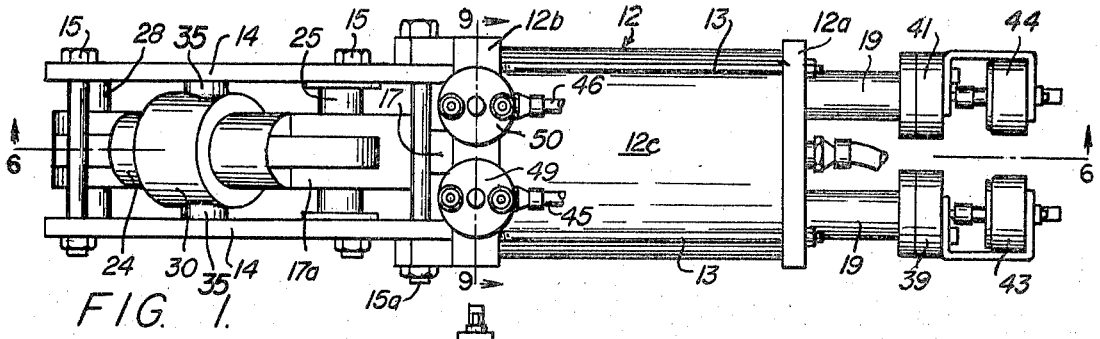
Figure 2:
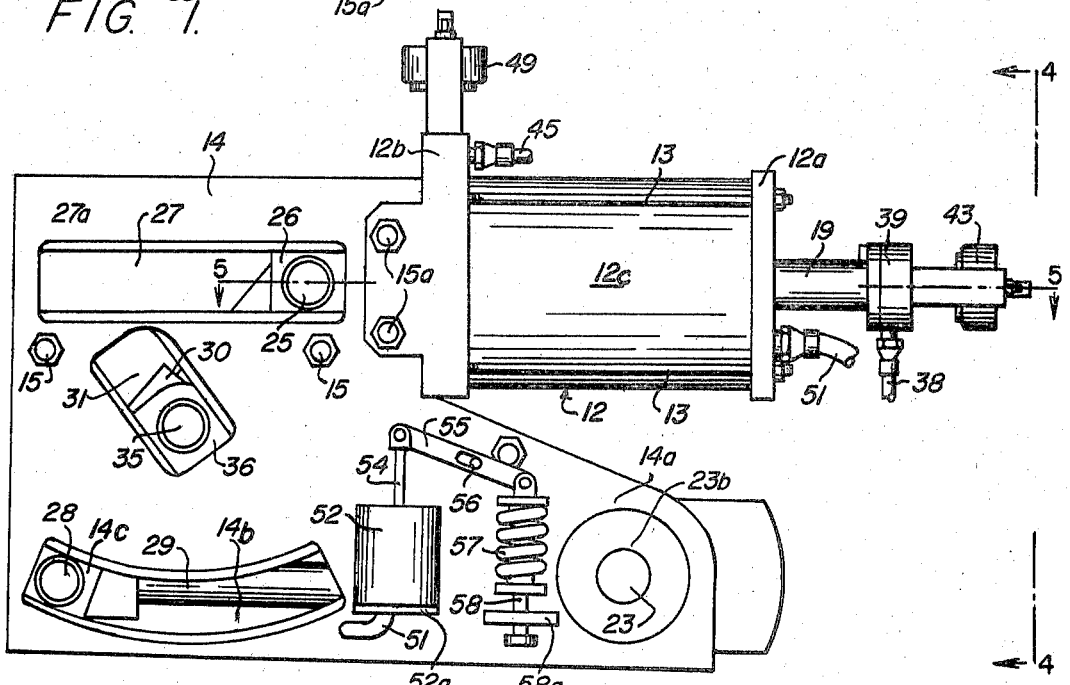
Figure 4:
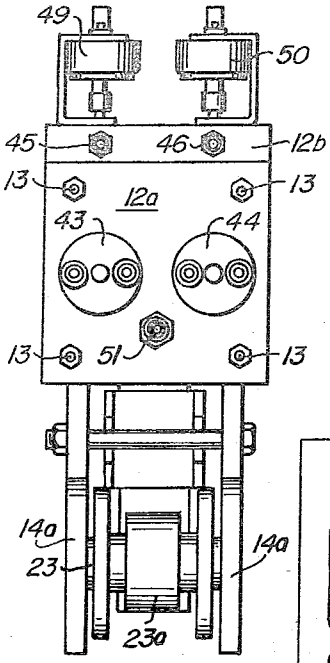

A power cylinder 12 having fixed heads or end caps **12*a* and 12*b*, respectively, held together in fluid-tight relationship with the open ends of a cylindrical body member 12*c* by elongate bolts 13, FIGS. 1,2, and 4, is supported by mutually spaced side plates indicated 14, respectively, which are rigidly secured in position relative thereto by bolts 15 and to which fixed head 12*b* is secured by bolts 15*a***.

A piston 16 is fixed to one end of a connecting rod 17 and is positioned within cylinder 12. A secondary cylinder head 18 is carried by corresponding ends of a pair of longitudinally movable, tubular shafts 19, respectively, and is adjustable in its position within cylinder 12 so as to change the size, i.e. volumetric capacity, of work-chamber 20 of power cylinder 12 from time to time as may be found desirable, compare FIGS. 6 and 7. Both piston 16 and secondary cylinder head 18 are provided with sealing rings 21.

Figure 5:
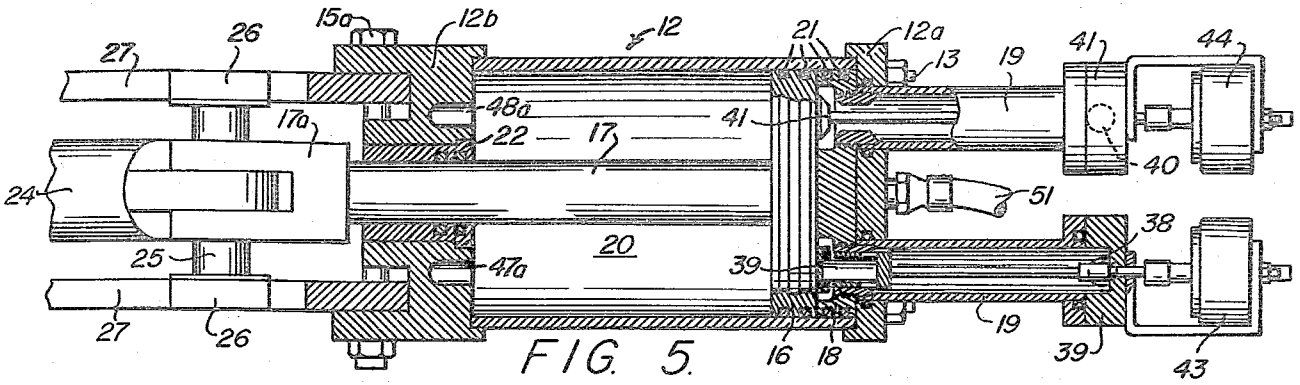
Figure 6:
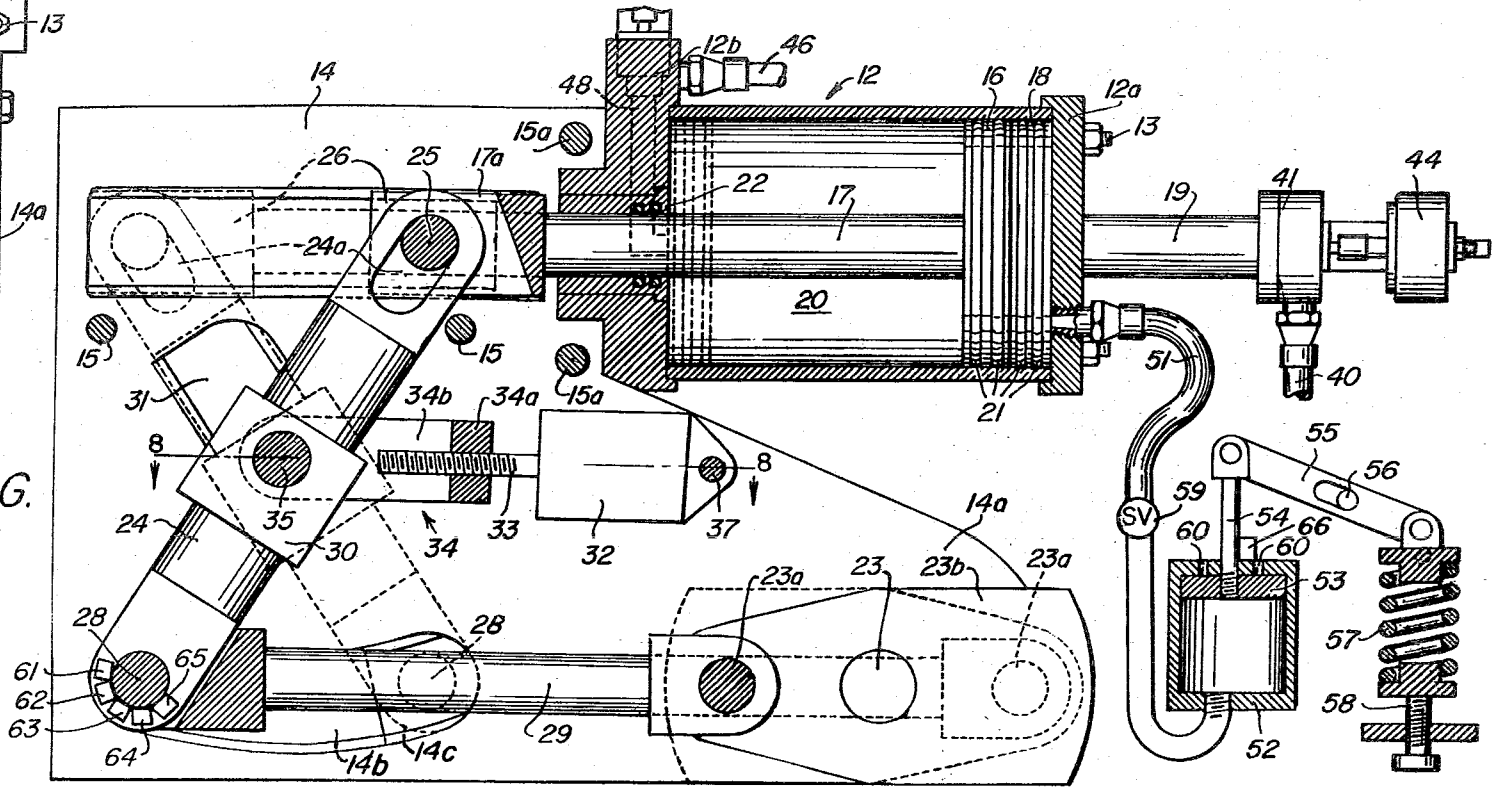

Connecting rod 17 of piston 16 extends slidably through and in fluid-tight relationship with a bronze bearing 22, FIGS. 5 and 6, in end cap 12*b* and is connected with crank 23*a* of a crankshaft 23 by means of special linkage that compensates for changes in length of the operating stroke of piston 16 due to changes in position of secondary cylinder head 18. Crankshaft 23 is rotatably mounted in extended portions 14*a* of the respective side plates 14.

The special linkage comprises a lever rod 24 having flattened ends, one of which is slotted, as at 24*a*, and is pivotally connected to the outer, clevis-formed end 17*a* of piston connecting rod 17 as by means of a pivot pin 25, which passes through slot 24*a* and is mounted at its opposite ends in respective slides 26, FIGS. 2 and 5, fitted into slideways 27, respectively, formed as slots in respective side plates 14 and lined with antifriction material or slide bearings 27*a*. The other, flattened end of lever rod 24 is similarly pivotally connected by a pivot pin 28 to the clevis-formed end of a connecting rod 29, whose other end is formed to pivotally receive crank 23*a*.

In order to best accommodate and confine the necessarily arcuate travel of the ends of lever rod 24 during back and forth movement of piston rod 17 and its outward clevis end 17*a*, so that the stroke of connecting rod 29 remains constant while the stroke of piston rod 17 varies, pivot pin 28 extends at its opposite ends into respective arcuate slideways 14*b*, FIGS. 2 and 6, formed in respective side plates 14 and lined with antifriction material or slide bearings 14*c* as are slideways 27. As shown in FIG. 2, the ends of pivot pins 28 are mounted in respective slides similar to slide 26. The arcuate movement of the opposite end of lever rod 24 is accommodated by slot 24*a* therein.

Lever rod 24 is provided with a fulcrum block 30, which establishes a center for the oscillating motion of such lever rod. The fulcrum block is shiftable, whereby during operation of the engine the distance travelled by the end of lever rod 24 which is connected to connecting rod 29 can be maintained constant regardless of changes in the distance travelled by its other end connected to piston rod 17. Thus, changes in the operating stroke of piston 16 by reason of changes in position of secondary cylinder head 18 can be compensated for, so the operating stroke of connecting rod 29 will not change.

Figure 8:
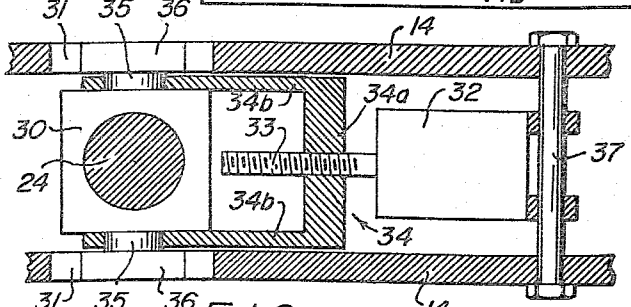
Figure 9:
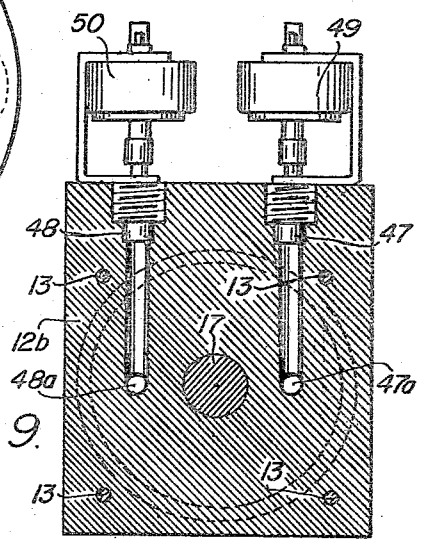

Fulcrum block 30 is slidable along lever rod 24 within the constraints of respective slideways 31 in side plates 14 (also lined with antifriction material or slide bearings as are slideways 27), see particularly FIGS. 2 and 8, its movement being effected by a reversible motor 32, FIGS. 6 and 8, or similar device under suitable control correlated with the movement of secondary cylinder head 18. In the form illustrated, motor 32, such as type SS Globe Motor manufactured by TRW, Inc. of Jamestown, N.Y., drives a screw-threaded spindle 33, which is screwed through the base member 34*a* of a clevis 34, the respective arms 34*b* of which clevis receive and journal stub shafts or pins 35 extending rigidly from opposite sides of fulcrum block 30. Stub shafts or pins 35 are received and journaled by respective slides 36 operable in the slideways 31, respectively. Motor 32 is pivotally carried by a pin 37 extending between and whose ends are received by side plates 14.

Figure 3:
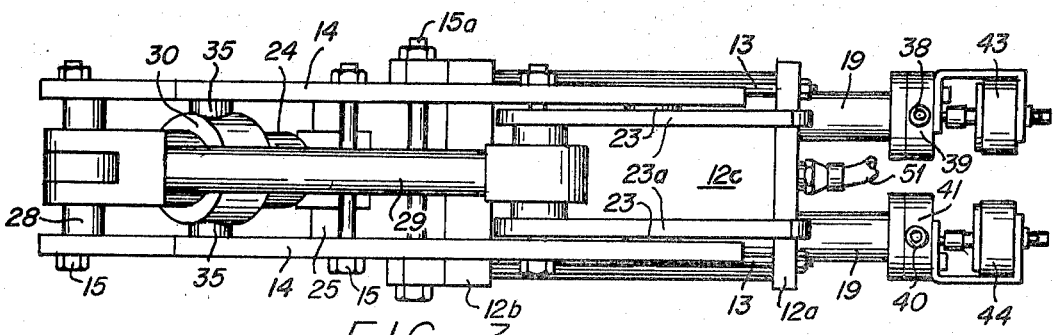

When spindle 33 is rotated in one direction by motor 32, fulcrum block 30 is moved along lever rod 24 in one direction, see FIGS. 1, 3, and 6, to adjust its position thereon, and, when rotated in the opposite direction, fulcrum block 30 is moved along lever rod 24 in the opposite direction to a reverse adjusted position thereon. This effectively accommodates changes in position of secondary cylinder head 18.

It should be noted that the several shafts and pivot pins are provided with antifriction bearings as indicated but not specifically designated in the drawings.

Piston 16 reciprocates within cylinder 12 by the application of pressure fluid, usually steam, alternately at its opposing faces accompanied by exhaust of such pressure fluid from the respective opposite faces. The pressure fluid is introduced into that portion of cylinder work chamber 20 that is between piston 16 and secondary cylinder head 18 from any suitable source of same (such as a steam generator, not shown, suitably mounted on the vehicle) by way of a hose 38 through corresponding tube 19 under the control of a conventional sleeve valve 39, FIG. 5, operable in secondary cylinder head 18, and is exhausted therefrom through other appropriate passages in such end cap 12*a*, corresponding tube 19, and a hose 40, under the control of a conventional poppet valve 41 also operable in secondary cylinder head 18, to a condenser (not shown) which recirculates to the steam generator. Valves 39 and 41 are operated by solenoids 43 and 44.

Alternately, the pressure fluid is introduced into and subsequently exhausted from the portion of cylinder work-chamber 20 that is between piston 16 and cylinder end cap 12*b*, such introduction and exhaust being from and to hoses 45 and 46, respectively, through corresponding sleeve and poppet valves 47 and 48 which are operated by solenoids 49 and 50, respectively, FIGS. 1, 2, and 4.

The position of secondary cylinder head 18 is adjusted similarly by introducing and exhausting pressure fluid between secondary cylinder head 18 and fixed cylinder head 12*a* and by retaining the introduced pressure fluid in accordance with operating requirements. Such introduction, retention, and exhaust are effected by means described hereinafter controlling passage of the pressure and exhaust fluid through hose 51.

Rankine cycle engines, such as described and illustrated herein, operate more efficiently when the size, i.e. the volumetric capacity, of work-chamber 20 of each cylinder is adjusted properly with respect to the torque load upon crankshaft 23. In general, for best efficiency, higher torques require larger cylinder capacity and vice versa. In the present engine, cylinder capacity (represented by the size of work-chamber 20) is adjusted for varying crankshaft torques by appropriate positioning of secondary cylinder head 18. The resulting change in the length of stroke of piston 16 and connecting rod 17 is compensated for by appropriate extension and retraction of fulcrum block 30 on lever rod 24.

The most efficient torque versus work-chamber size relationship may be theoretically estimated or empirically determined, and the work-chamber size precisely mathematically related to the position of fulcrum block 30 on lever rod 24.

In accordance with the invention, proper control of the positioning of secondary cylinder head 18 within power cylinder 12 and of the positioning of fulcrum block 30 on lever rod 24 are accomplished by mechanism shown in FIG. 2 and schematically in FIG. 6, which includes a dash pot 52 having a piston 53 carried by a piston rod 54. Piston rod 54 has its exterior end pivotally secured to one end of a lever 55, which is fulcrumed at 56 and resiliently held at its oposite end by a spring 57, tensioned by an adjustable screw-mounting 58 and pivotally connected to the opposite end of lever 55.

The mechanism can be mounted in any convenient manner relative to the engine, for example by attachment of platform brackets 52*a* and 58*a* to the extension 14*a* of one of the side plates 14 as shown in FIG. 2.

Figure 7:
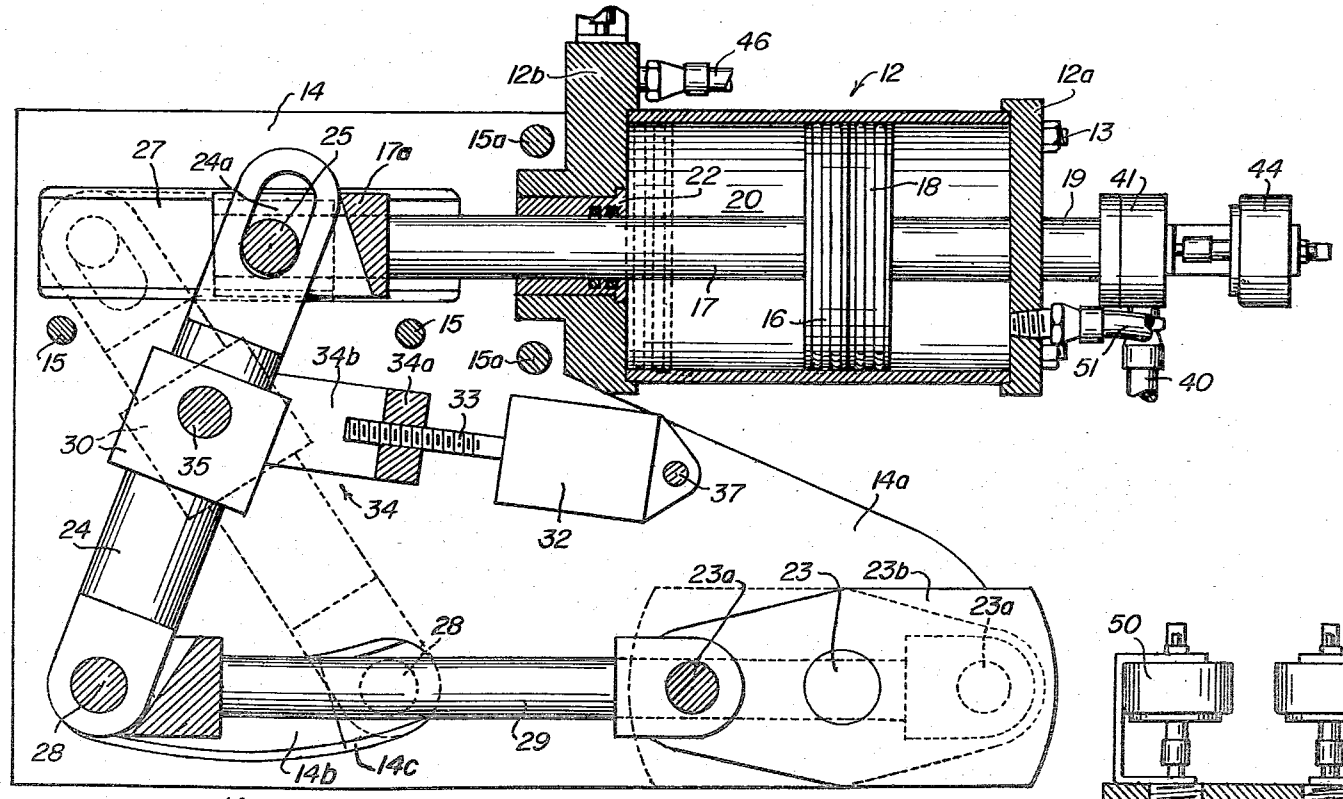

A solenoid-operated, normally open valve 59, FIG. 6, is interposed in hose 51 so as to close and prevent a rush of hydraulic fluid from dash pot 52 into cylinder 12 between stationary cylinder head 12*a* and secondary cylinder head 18 upon exhaust of pressure fluid from work chamber 20 to the right of piston 16, FIGS. 5, 6, and 7, on the righthand stroke of piston 16.

Hose 51 enters dash pot 52 at its bottom, and openings 60 are supplied in the top wall of the dash pot to vent the upper dash pot chamber above piston 53.

The size of the flow connection between cylinder 12 and dash pot 52 will be a factor in how fast the position of cylinder head 18 will change. Thus, if the flow path for hydraulic fluid between dash pot 52 and work cylinder 12 is relatively small so flow of fluid is restricted, the time required for the position of such cylinder head to change its position is greater than if the connection is large so the flow is relatively unrestricted. It is preferred that the connection be as large as possible so that the change in position, even between extreme positions, will be rapid.

Valve 59 opens to permit back pressure flow from cylinder 12 into dash pot 52 when head 18 is repositioned for increasing the stroke of piston 16. Such repositioning is automatically effected by and is dependent upon the pressure of steam or other pressure operating fluid entering cylinder work chamber 20 through valve 39 and the corresponding tube 19 under the control of an accelerator pedal or the like, which is normally manually operated by a person in charge of the engine, such person being the driver of the vehicle in instances in which the engine is used to power a vehicle. If the torque is high, more pressure fluid is required to overcome the torque, and vice versa. It is the variation in quantity of operating pressure fluid which determines the position of secondary cylinder head 18. Whether or not there is a back pressure flow of hydraulic fluid into dash pot 52 through valve 59 depends upon the tension of spring 57. Spring tension is set manually to balance maximum operating fluid pressure for which the machine is designed.

In this connection, it should be noted that the position of secondary cylinder head 18 is also controlled under reduced pressure of pressure operating fluid by spring 57, which causes dash pot piston 53 to force hydraulic fluid into power cylinder 12 between such head 18 and fixed cylinder head 12*a* through hose 51 until the pressure of the pressure operating fluid and spring tension are balanced.

Operating control of the engine is effected on the basis of feedback and involves sensors to indicate motion and changes in position of certain parts. In the present embodiment, signals from the sensors are sent to a standard analog to digital converter, which feeds a standard microprocessor used in conjunction with a memory. The microprocessor controls supply of electricity to the various valve solenoids so as to synchronously operate valves 47 and 48 controlling the introduction and exhaust of steam or other operating pressure fluid to and from cylinder work chamber 20 of cylinder 12, valve 59 between dash pot 52 and cylinder 12, and reversible motor 32 controlling the position of fulcrum block 30.

Figure 10:
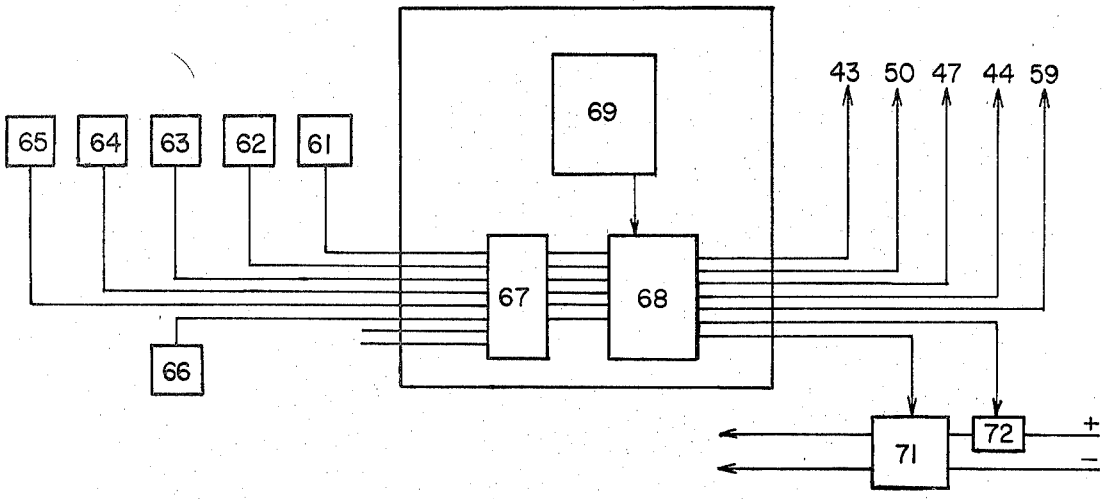

As presently contemplated, see FIGS. 6 and 10, five sensors 61, 62, 63, 64 and 65, are mounted on lever rod 14 about pivot pin 28 so as to sense relative rotational movement between the two and thus give an indication of the position of that end of rod 24. These sensors may be rotary, variable, differential transformers, such as Model R13DC produced by Schaevitz Engineering Company of Pennsaukin, N.J.

A sixth sensor 66 is mounted on the top of dash pot 52 and is coupled to piston rod 54 so as to give an indication of the position of piston 53 within the dash pot. A suitable sensor is a linear, variable, differential transformer, such as Model 050HR-DC manufactured by Schaevitz Engineering Company.

The output of each of the specified sensors is an analog voltage and is converted to a digital signal by analog to digital converter 67, also indicated in FIG. 10 as a block in the block diagram. The digital signals are then fed to a microprocessor 68, where they are compared with preset values fed to the microprocessor from memory 69. The output signals from microprocessor 68 are used to control operation of the engine, as will be described.

Analog to digital converter 67, microprocessor 68, and memory 69 may conveniently all be included as a single microcomputer unit, such as an AMI s2000 family, which includes an analog to digital converter, such as a Micro PD 8080 AF manufactured by N.E.C. Computers, Inc., an 8-bit microprocessor such as that manufactured by AMI, and a programmable read-only memory such as a Micro PD 458 manufactured by N.E.C. Computers, Inc.

In operation, sensors 61, 63, and 65 are arranged to sense relative rotational movement between lever 24 and pivot pin 28 as pivot pin 28 moves to the right from the standpoint of FIG. 6. The signal output from sensors 61 and 63 will be voltages proportional to the position of pin 28 along its path of travel. Sensors 62 and 64 are arranged to measure relative rotational movement between lever rod 24 and pin 28 during movement of pin 28 from the rightward extreme of its travel, shown in broken lines in FIG. 6, to the left. Again, the output signals of sensors 62, 64 and 65 will be voltages proportional to the position of pin 28 along its path of travel from right to left in FIG. 6.

The position of pin 28 along its path of travel in either direction will be proportional to the distance moved by piston 16 along its stroke in cylinder 20. Thus, as pin 28 reaches the end of its travel, as shown in full lines in FIG. 6, piston 16 will have reached the end of its stroke, as shown in solid lines. Similarly when pin 28 reaches the position shown in broken lines, FIG. 6, piston 16 will have reached the end of its stroke, as shown in dotted lines. This will be true regardless of the length of the stroke of piston 16.

Sensor 61 is used to control operation of solenoid 43, which operates valve 39 to allow operating pressure fluid to flow into work chamber 20 to force piston 16 to the left as shown in FIG. 6. Sensor 62 is used to control solenoid 50, which operates valve 48 to open and close exhaust port 48*a* through which fluid is exhausted from chamber 20 to the left of piston 16. Similarly, sensor 63 is used to control solenoid 49, which operates valve 47 to open and close port 47*a* through which pressure fluid flows into work-chamber 20 to the left of piston 16, and sensor 64 is used to operate solenoid 44, which operates exhaust valve 41 controlling exhaust from chamber 20 to the right of piston 16.

The signals from sensors 61, 62, 63, and 64 are converted to digital signals by analog to digital converter 67 and are fed to microprocessor 68. Microprocessor 68 will individually compare the signals from each of the sensors with preset limit signals from memory 69, and, if such signals are between the respective maximum and minimum values, will cause operation of the respective solenoids. For example, if the engine is in the position shown by solid lines in FIG. 6, with piston 16 at the right end of its stroke, the value of the signal generated by sensor 62 and the values of the preset limits will be such as to cause microprocessor 68 to generate a signal which will operate solenoid 50 to open valve 48, thereby opening work-chamber 20 to the left of piston 16 to exhaust.

The value of the signal generated by sensor 61 and the value of the preset limits will be such as to cause microprocessor 68 to produce a signal which will operate solenoid 43, thereby opening valve 39 so that pressure fluid is introduced into work-chamber 20 to the right of piston 16. This causes piston 16 to move to the left. When pin 28 has moved through most of its stroke to the right, thus indicating that piston 16 has almost completed its stroke to the left, the value of the signal generated by sensor 61 and the value of the preset limits will be such as to cause the microprocessor to discontinue its signal which operates solenoid 43, thereby closing valve 39 and stopping the inflow of pressure fluid into work-chamber 20.

As piston 16 reaches the lefthand end of its stroke, the value of the signal generated by sensor 62 and the value of the preset limits will be such as to cause microprocessor 68 to discontinue its signal to solenoid 50, thereby closing exhaust port 48. At that point, the value of the signal generated by sensor 64 and the value of the preset limits will be such as to cause the microprocessor to produce a signal that will operate solenoid 44, thereby opening exhaust valve 41 which opens work-chamber 20 to the right of piston 16 to exhaust, and the value of the signal generated by sensor 64 and the value of the preset limits will be such as to cause microprocessor 68 to produce a signal that will operate solenoid 49 opening valve 47 so that pressure fluid is introduced into work-chamber 20 to the left of piston 16 causing it to begin its stroke to the left.

As indicated above, solenoid valve 59 must be open at all times other than during the power stroke of piston 16 to the right. For this purpose, the solenoid of valve 59 is spring-loaded to open position. Closure of valve 59 at such time as piston 16 moves to the right prevents secondary cylinder head 18 from moving toward fixed cylinder head 12*a* under sudden reduced pressure conditions during exhaust. Thus, the value of the signal generated by sensor 65 and the value of the preset limits will be such as to cause microprocessor 68 to produce a signal to close valve 59 during the power stroke of piston 16 to the right, which signal represents the time that valve 47 is open to allow pressure fluid into work-chamber 20 to the left of piston 16.

Figure 11:
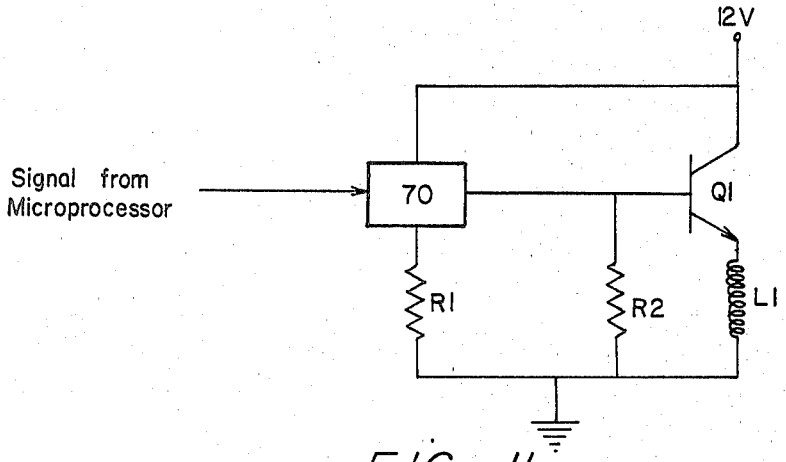

The output signals of microprocessor 68 are signals of either zero volts or 5 volts. The 5-volt signals are used to operate the solenoids. These signals, however, cannot directly operate the solenoids because of current requirements. Therefore, a standard circuit, such as shown in FIG. 11, may be utilized to operate such solenoids. Signals from the microprocessor are sent to an optical isolator 70. This isolates the microprocessor from the power circuitry and prevents any possible damage to the microprocessor. Resistor R1 is a current limiting resistor. When a 5 volt signal is present on the line from the microprocessor, a signal appears on the output of the isolator 70 across resistor R2 and on the base of transistor Q1. This voltage turns transistor Q1 "on," which allows the 12 volts on the collector of Q1 to appear across the solenoid coil L1, thereby activating the solenoid. With 0 volt output from the microprocessor, there is essentially no voltage across resistor R1, so transistor Q1 is "off" and no voltage appears across solenoid coil L1. It will be understood that a separate circuit, such as shown in FIG. 11, will be associated with each solenoid.

Although five separate sensors are shown to sense relative movement of lever rod 24 and pin 28, it should be understood that circuit rearrangements within the ordinary skill of the art may permit a lesser number of sensors to be used and the information from those lesser number of sensors to be processed in much the same way as described to give the desired output signals. For example, a single sensor giving the same type of location information might be used to control all of the solenoid valves through the microprocessor. Different types of sensors and different locations might also be used to give the same information.

Sensor 66 located on dash pot 52 is used to produce a signal indicative of the position of secondary cylinder head 18. It detects movement of piston rod 54 and produces a voltage signal which is proportional to the position of both dash pot piston 53 and secondary cylinder head 18. The position of cylinder head 18 determines the size of cylinder chamber 20 and the length of the stroke of piston 16. The position of cylinder head 18 is used to control the reversible motor 32 which controls the position of fulcrum block 30. Motor 32 is controlled by a reversing switch 71, such as an Electronic Relays, Inc. Model S541. A switch 72, such as a standard solid state relay, controls the power to reversing switch 71. The analog signal from sensor 66 is converted to a digital signal by analog to digital converter 67, which, in turn, gives a digital signal to microprocessor 68 indicative of the position of cylinder head 18. The microprocessor matches this position information with a table in memory, which indicates the necessary corresponding position of fulcrum block 30 and produces dual output signals to cause movement of the fulcrum block to that position. One of the dual output signals is sent to reversing switch 71 to position it in accordance with the polarity of the power to be sent to motor 32, and the second is sent to switch 72 to establish duration motor actuation necessary to move the fulcrum block to the desired position. Thus, a zero volt output signal to switch 71 will indicate one polarity to the motor, while a 5 volt output signal to switch 71 will indicate the opposite polarity to the motor. A 5 volt output signal to switch 72 will cause power to be supplied through switch 71 to motor 32, and a zero volt output to switch 72 will stop the supply of power to the motor. With no power to the motor, the fulcrum point remains in fixed position. The microprocessor is programmed to continuously keep track of the actual position of the fulcrum point so that it can calculate the time and direction that the motor must run in order to move fulcrum block 30 to the desired location at any time.

While sensor 66 is shown located on the dash pot 52, various types of sensors could be used and located in various positions to produce signals proportional to the location of secondary cylinder head 18, and sensors could be used rather than or in conjunction with the microprocessor to provide information as to the actual location of the fulcrum point at any time.

The exact synchronization for opening or closing valves or for performing other functions in regard to operation of the machine may require some testing under varied load contitions. For this purpose, the memory may be field programmable so that optimum values may be found. Once the optimum values are found, however, these values can be incorporated into a non-programmable memory chip for production.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A variable-torque-accommodating machine, comprising at least one piston and cylinder, the piston being fixed to a piston rod at one end thereof and adapted to reciprocate within the cylinder, the opposite end of said piston rod extending exteriorly of the cylinder and the cylinder having fixed cylinder heads closing respective opposite ends thereof and having a secondary cylinder head adjacent to one of the fixed cylinder heads and movable back and forth within the cylinder in opposition to the piston, the piston rod extending exteriorly of the cylinder through the other fixed cylinder head; work means; a connecting rod connected to the work means and adapted to be reciprocated for operating said work means; a lever rod pivotally linking the piston rod with the connecting rod so that reciprocation of the former will reciprocate the latter; fulcrum means mounted on the lever rod for back and forth movement therealong as a shiftable fulcrum for said lever rod; means associated with opposite ends of the lever rod and with said fulcrum means for constraining travel of the linked ends of the piston rod and the connecting rod and of the fulcrum means to predetermined paths so that the stroke of said connecting rod remains constant while the stroke of said piston rod is varied; means for moving said secondary cylinder head forwardly or backwardly in the cylinder in response to changes in torque encountered by the work means from time to time during operation of said machine; means for similarly shifting said fulcrum means along the lever rod; means for introducing a pressure fluid into the cylinder alternately at opposite faces of the piston; means for exhausting said pressure fluid from said cylinder alternately at opposite faces of said piston while the pressure fluid is being introduced into the cylinder at the respective reverse faces of said piston; and means for controlling said secondary-cylinder-head-moving-means and said fulcrum-means-shifting-means in accordance with changes in torque encountered by the work means from time to time during operation of said machine.

2. A variable-torque-accommodating machine according to claim 1, wherein the work means is a crankshaft having cranks corresponding in number to the number of piston and cylinder mechanisms in the machine.

3. A variable-torque-accommodating machine according to claim 1, wherein the means for controlling the secondary-cylinder-head-moving-means and the fulcrum-means-shifting means comprises position sensors respectively associated with said secondary-cylinder-head-moving-means and with the pivotal connection of the lever rod with the connecting rod, and data processing means arranged to receive signals from said position sensors and arranged and programmed to operate the respective means accordingly.

4. A variable-torque-accommodating machine in accordance with claim 3, wherein the secondary-cylinder-head-moving-means and the fulcrum-means-shifting-means comprise a hydraulic cylinder and piston dash pot mechanism wherein movement of the dash pot piston in one direction is retarded by restricted air-exhaust openings and movement in the other direction is resiliently effected by a spring energized by movement of said dash pot piston in said one direction, said dash pot mechanism being in fluid flow communication with the portion of the machine cylinder between the secondary cylinder head and the corresponding fixed cylinder head so movement of said dash pot piston under the urging of said spring will force hydraulic fluid from the dash pot cylinder into said portion of the machine cylinder between the secondary cylinder head and the confronting fixed cylinder head, a normally open valve being interposed in the path of fluid flow between said dash pot mechanism and the said portion of the machine cylinder; and wherein closing of said valve is controlled by a position sensor associated with the pivotal connection of the lever rod with the connecting rod; and wherein the fulcrum-means-shifting means is controlled by a position sensor associated with said dash pot piston for producing a signal indicative of the position of the secondary cylinder head.

5. A variable torque accommodating means according to claim 3, wherein the data processing means is programmed with preset maximum and minimum limit signals with which incoming signals from the position sensors are compared.

6. A variable-torque-accommodating machine in accordance with claim 4, wherein the valve is operated by a spring-loaded solenoid and the means for controlling the secondary-cylinder-head-moving means and the fulcrum-means-shifting means are electrical in character; and wherein the position sensors and data processing means are of a type which operate on the basis of electrical signals.

7. A variable-torque-accommodating machine in accordance with claim 1, wherein the means for introducing pressure fluid into the cylinder alternately at opposite faces of the piston and the means for exhausing pressure fluid from the cylinder alternately at opposite faces of the piston comprise respective pressure fluid supply passages and respective exhaust passages; respective valves in said supply passages and in said exhaust passages; and respective means for activating said valves.

8. A variable-torque-accommodating machine in accordance with claim 6, wherein one set of a supply passage and an exhaust passage are provided by respective tubes extending through the secondary cylinder head and slidably mounted in the corresponding fixed cylinder head for back and forth movement relative thereto.

9. A variable-torque-accommodating machine in accordance with claim 7, wherein the means for activating the valves are respective solenoids.

10. A variable-torque-accommodating machine in accordance with claim 1, wherein the means associated with opposite ends of the lever rod for constraining travel to predetermined paths are fixed slideways, and slides pivotally secured to opposite ends of the lever rod and mounted for back and forth movement in said slideways.

11. A variable-torque-accommodating machine in accordance with claim 1, wherein the fulcrum means is a block slidably mounted on the lever rod as a sleeve for back and forth movement therealong and is constrained to travel along a predetermined path by slide means secured thereto and mounted in fixed slideway means.

12. A variable-torque-accommodating machine in accordance with claim 11, wherein the fulcrum means-shifting means comprises a clevis member in which the fulcrum means is journaled, a screw-threaded spindle in threaded engagement with the fulcrum means, and a reversible motor arranged to drive said spindle in one or the other directions.

* * * * *